US009868144B2

(12) United States Patent
Artmayr et al.

(10) Patent No.: US 9,868,144 B2
(45) Date of Patent: Jan. 16, 2018

(54) BENDING TOOLS FOR PRE-BENDING AND HEMMING

(71) Applicant: TRUMPF Maschinen Austria GmbH & Co. KG., Pasching (AT)

(72) Inventors: Reinhard Artmayr, Wolfern (AT); Emanuel Schmee, Marchtrenk (AT)

(73) Assignee: TRUMPF Maschinen Austria GmbH & Co. KG., Pasching (AT)

( * ) Notice: Subject to any disclaimer, the term of this patent is extended or adjusted under 35 U.S.C. 154(b) by 233 days.

(21) Appl. No.: 14/780,117

(22) PCT Filed: Mar. 27, 2014

(86) PCT No.: PCT/AT2014/050076
§ 371 (c)(1),
(2) Date: Dec. 16, 2015

(87) PCT Pub. No.: WO2014/153586
PCT Pub. Date: Oct. 2, 2014

(65) Prior Publication Data

US 2016/0096213 A1 Apr. 7, 2016

(30) Foreign Application Priority Data

Mar. 28, 2013 (AT) ..... A 50217/2013

(51) Int. Cl.
*B21D 17/02* (2006.01)
*B21D 19/08* (2006.01)
(Continued)

(52) U.S. Cl.
CPC ..... *B21D 19/08* (2013.01); *B21D 5/0209* (2013.01); *B21D 5/16* (2013.01)

(58) Field of Classification Search
CPC ..... B21D 19/08; B21D 5/0209; B21D 5/16
(Continued)

(56) References Cited

U.S. PATENT DOCUMENTS 4,509,357 A * 4/1985 Zbornik ..... B21D 5/0209 72/384
4,805,438 A * 2/1989 Ginn, Jr. ..... B21D 19/08 72/384
(Continued)

FOREIGN PATENT DOCUMENTS

CN 101 665 515 A 3/2010
DE 2 652 886 A1 5/1978
(Continued)

OTHER PUBLICATIONS

International Search Report of PCT/AT2014/050076, dated Jul. 1, 2014.
(Continued)

*Primary Examiner* — David B Jones
(74) *Attorney, Agent, or Firm* — Collard & Roe, P.C.

(57) ABSTRACT

A bending die for pre-bending a workpiece section includes a die section with a slot for partially receiving a bending punch for hemming a workpiece section during hemming, the slot leading from a bearing surface into the interior of the bending die, and a hemming section, arranged laterally with respect thereto, with a hemming surface. The bending punch includes a punch section (12) extending from a punch base surface and a hemming section, arranged laterally thereto, with a hemming surface. In this case, the hemming surface on the bending die is set back in a step-like manner with respect to a bearing surface of the die section, with the result that a stop surface extending from the bearing surface to the hemming surface is formed and the hemming section on the bending punch protrudes with respect to the punch base surface in the direction of the punch tip, with the result that the hemming surface protrudes in a step-like manner with respect to the punch base surface.

11 Claims, 3 Drawing Sheets

(51) Int. Cl.
*B21D 5/02* (2006.01)
*B21D 5/16* (2006.01)

(58) Field of Classification Search
USPC ..... 72/470
See application file for complete search history.

(56) References Cited

U.S. PATENT DOCUMENTS

| | | | | |
|---|---|---|---|---|
| 4,852,379 | A * | 8/1989 | Levenberg | B21D 5/16 211/59.3 |
| 4,918,971 | A | 4/1990 | Makino | |
| 5,750,603 | A | 5/1998 | Asrar | |
| 7,997,115 | B2 | 8/2011 | Tidl et al. | |

FOREIGN PATENT DOCUMENTS

| | | | |
|---|---|---|---|
| DE | 3 638 083 | A1 | 5/1988 |
| DE | 3 911 858 | A1 | 11/1989 |
| EP | 2 092 992 | A2 | 8/2009 |
| FR | 1 132 633 | A | 3/1957 |
| FR | 1 163 931 | A | 10/1958 |
| WO | 2010/099559 | A1 | 9/2010 |

OTHER PUBLICATIONS

International Preliminary Report on Patentability of PCT/AT2014/050076, dated Sep. 28, 2015.

* cited by examiner

BENDING TOOLS FOR PRE-BENDING AND HEMMING

CROSS REFERENCE TO RELATED APPLICATIONS

This application is the National Stage of PCT/AT2014/050076 filed on Mar. 27, 2014, which claims priority under 35 U.S.C. §119 of Austrian Application No. A 50217/2013 filed on Mar. 28, 2013, the disclosure of which is incorporated by reference. The international application under PCT article 21(2) was not published in English.

The invention relates to a bending die and a bending punch for the v-shaped prebending and subsequent hemming of a flat workpiece section.

From the prior art various different bending tools are known for creating on a workpiece of formable material an edge section of the workpiece by deforming by about 180° onto the rest of the workpiece and thereby reinforcing or rounding off the edge of the workpiece. This type of deformation is also referred to as a fold or turnover and can also be produced by suitable bending tools, which are also referred to as folding tools or hemming tools, on a conventional bending press.

In common tool variants the workpiece is prebent to form a sharp edge at one edge and the thereby created bent section is then pressed and formed between two hemming surfaces against the remaining workpiece. The bending tools used for this thus have structural features which in a first forming step enable the prebending of the workpiece, preferably by means of a free bending process, and in a second forming step enable the hemming of the prebent workpiece. As in this way different active surfaces are used on the bending tools there are embodiments of hemming tools in which the bending dies have components which can be adjusted relative to one another or in which by changing the position of the bending die between the forming steps consecutively different active surfaces come into engagement. Such embodiments require either complicated bending dies or complex adjusting mechanisms on the bending press for changing the position of the bending dies.

An embodiment of folding tools, which comprises bending tools without movable or adjustable components which are fixed relative to the respective tool mounts on the folding press, comprises a bending die, which on its upper side comprises a bearing surface for a workpiece and in the bearing surface comprises a die section, into which the workpiece is pushed by means of the tip of a bending punch and the workpiece can thus be prebent at an acute angle. In a second step the prebent workpiece is pressed together between a hemming surface formed on the bending punch and the bearing surface of the bending die. The hemming surface on the bending punch is set back relatively far with respect to the tip of the bending punch and in order to move the hemming surface up to the bearing surface of the bending die the bending die comprises in the die section a slot leading into the interior of the bending die, in which the bending punch can be received during the hemming process.

To perform the hemming process in this embodiment the bending punch is moved up to the bending die so that between the hemming surfaces a slot remains which is suitable for receiving the prebent workpiece and the workpiece is inserted into the latter until it strikes the bending punch.

A disadvantage of this embodiment is that with larger die widths by means of the latter an intermediate space is formed between the bearing surface on the upper side of the bending die and the inserted bending punch into which the workpiece can deflect during hemming and thereby the intended forming process can be severely disrupted as the hemming process is performed inadequately. To avoid this for bending dies with different die widths in general a separate bending punch with a suitable punch thickness is necessary in order to avoid the aforementioned intermediate space or keep it as small as possible. A bending tool set for folding different metal sheet thicknesses therefore comprises in addition to several bending dies with different die widths several bending punches with different punch thicknesses, which thus leads to high acquisition costs for such a tool set and the changing of workpieces with different metal sheet thicknesses is also associated with high equipment costs.

Document FR 1 163 931 A describes a bending device comprising a bending die and a bending punch for the Z-like prebending and subsequent hemming of a flat workpiece. The bending punch comprises in this device on two sides offset by 90° on the one hand a pro-filed pressing surface for prebending and on the other hand a planar pressing surface for hemming the workpiece. Accordingly, the bending punch has to be pivoted back and forth alternately by 90° for performing the prebending and subsequent hemming. In the case of the die on the bending die on a single side next to one another there is a pressing surface area for the Z-shaped prebending and on the other side a pressing surface for the hemming.

Document FR 1 132 633 A describes a bending press in which a bending die is used which on four sides comprises V-shaped depressions for the right-angled bending of planar work-pieces. The four V-shaped depressions also have different die widths or different depths. If necessary the thus configured bending die can be arranged differently pivoted by 90° respectively.

Document DE 26 52 886 A1 has a bending processing device as a subject matter, in which on a movable plunger or on a bending tool connected securely to the plunger one or two additional bending tools are arranged, which are adjustable in height relative to the first bending tool.

In document WO 2010/099559 A1 a tool is described for free bending with an adjustable die. In this case also an embodiment of a combination of a bending punch and a bending die is described, by means of which a V-shaped prebending and subsequent hemming of a flat workpiece section can be performed.

The objective of the invention is to avoid the disadvantages of the bending tool combinations known from the prior art.

The objective of the invention is achieved by a generic bending die with the characterizing features according to one aspect of the invention or a bending punch with the characterizing features according to another aspect of the invention.

Since, on the bending die the hemming surface is set back step-like relative to a bearing surface of the die section and in this way a stop surface extending from the bearing surface to the hemming surface is formed, an optimal hemming surface, not influenced by the design of the die width and the thickness of the bending punch is provided on the bending die, whereby a high-quality fold forming process is ensured during the hemming process. Furthermore, a plurality of such bending dies, which have different die widths, can be used with the same bending punch, without the result of the hemming process being affected thereby.

According to one possible embodiment of the bending die, the slot for receiving the bending punch adjoining the outerlying die section has a support section with an internal support width which corresponds to the thickness of the bending punch in addition to a small amount of play. The relatively slim part of the bending punch is thereby supported mechanically during the hemming process and the mutual alignment of the bending die and bending punch is ensured perpendicular to the working direction. To ensure that the lateral support is not provided in a point-like manner, it is an advantage if the internal support width in the support section is constant over an area, i.e. planar support surfaces are provided in the support section.

Furthermore, a mount contour adjoining the support section can be widened in the direction of an inner end section of the slot, i.e. have a internal width that is greater than the support section, whereby the wear of the bending punch is reduced in the region of the tip.

In order not to additionally reduce by means of a notching effect the strength of such a bending die, which is reduced by the slot, it is an advantage, if a mount contour adjoining the support section in the inner end section of the slot is rounded with radii of curvature or a radius of curvature of at least 2 mm.

If the hemming surface is designed to be set back between 30% and 75% of the die width relative to the bearing surface, then the size of the stop surface is well adapted for the sharp-edged prebent workpiece.

A load-adapted material and weight-saving embodiment of a bending die is achieved if the latter on the side relative to the working plane opposite the hemming section has a material cross section that tapering towards the die section.

In order to avoid as far as possible the premature wear of the active surfaces during forming on the bending die, it is an advantage if the die section and the hemming surface have hardened surfaces, in particular are laser hardened.

As, with a bending punch according to the invention the hemming section projects relative to the punch base surface in the direction of the bending punch tip, whereby the hemming surface projects step-like relative to the punch base surface and between the punch section and hemming surface an intermediate space is formed, such a bending punch can be used with a bending die according to the invention, whereby also the associated, previously described advantages can be achieved. In particular, by means of such a bending punch folding forms can be produced with different bending dies having different die widths.

It is an advantage in this case if the hemming surface or the hemming section perpendicular to the operating direction has a larger dimension than the cross-section of the punch section, as the forming forces required during the hemming process can be significantly greater than the forces required for prebending.

In order to perform prebending with the sharpest possible edge it is advantageous if the hemming section is arranged completely between the working plane of the punch section and a contour plane coming from the tip of the punch section and inclined by an angle of less than 20° to the working plane. As the bending punch can also be used for free bend forming without a subsequent hemming process, in this embodiment of the hemming section there is no disruptive contour which restricts the bending free space.

In order to reduce the premature wear of the active surfaces on the bending punch during forming it is an advantage if the tip of the punch section and the hemming surface have hardened surfaces, in particular are laser-hardened.

The invention also relates to a bending tool combination composed of a bending die according to the invention and a bending punch according to the invention for the v-shaped prebending and subsequent hemming of a flat workpiece section, whereby the aforementioned advantageous effects of a bending die according to the invention and a bending punch according to the invention can be used optimally.

Lastly, the invention also relates to a bending tool set for the v-shaped prebending and subsequent hemming of a flat workpiece section, comprising one or more bending punches with a constant punch thickness perpendicular to the working direction and at least two bending dies with slots leading into the interior of the bending die for receiving the bending punch during the hemming, and die sections which have different die widths in the region of their bearing surface for a flat workpiece section.

Owing to the fact that the bending dies on the inside of the slot have an identical internal support width corresponding to the punch thickness in addition to play and the use of bending dies according to the invention and a bending punch according to the invention, workpieces with different metal sheet thicknesses can be processed by means of such a tool set because of the different die widths, whereby on changing between bending dies of different die widths a change of the bending punch is not necessary.

On the basis of the hemming surface which is independent of the die section and thus the die width there is no risk that the prebent workpiece will become deformed when hemming into the die, as in the prior art in bending dies with a larger die width, and thereby that unwanted deformation and insufficient hemming may occur.

For a better understanding of the invention the latter is explained in more detail with reference to the following Figures.

In a schematically much simplified representation:

Figure 1:
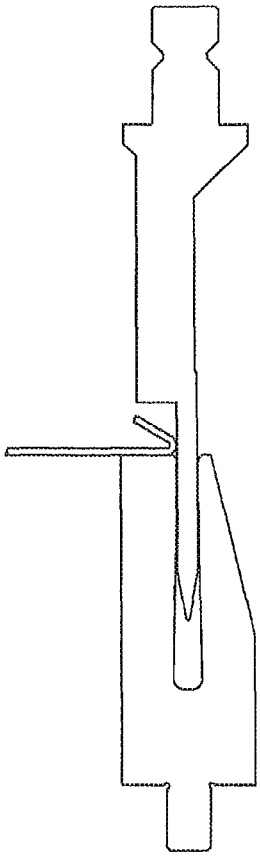
Fig.1 Prior Art
FIG. 1 is a generic bending tool combination known from the prior art.

FIG. 1 shows a bending tool combination for pre-bending and hemming a flat workpiece section known from the prior art. The bending tool combination comprises a bending die, which on its upper side comprises a bearing surface for the workpiece and in the bearing surface a die section, into which the workpiece is pushed by means of the tip of a bending punch and thereby the workpiece can be prebent at an acute angle. In a second step the prebent workpiece is pushed between a hemming surface formed on the bending punch and the bearing surface of the bending die. FIG. 1 shows the pushing together phase.

The hemming surface on the bending punch is set back relatively far with respect to the tip of the bending punch and connects directly at a right angle to the punch section. In order to move the hemming surface up to the bearing surface of the bending die, the bending die comprises in the die section a slot leading into the interior of the bending die in which the bending punch can be received during the hemming process. In order to easily position the prebent workpiece for the hemming process, the bending punch is moved up to the bending die so that the punch section projects into the slot and thereby the shaft of the punch section forms a stop surface for the prebent workpiece and thus the positioning of the prebent workpiece between the hemming surfaces is made easier.

For bending workpieces with a greater metal sheet thickness a greater die width may be necessary in order to facilitate the prebending or allow it at all. However, with a greater die width it may be the case that during the hemming the workpiece is drawn slightly into the die section, i.e. into the transitional area between the bearing surface and the slot of the bending die. This may result in unwanted deformations of the workpiece, in particular the hemming process may produce an unsatisfactory result. In order to avoid this drawing in of the workpiece during the hemming process, it is necessary that in bending dies with different die widths slot widths adapted to the die width are also provided and therefore for different bending dies also fitting, different bending punches are required, whereby when processing workpieces with varying metal sheet thicknesses bending tools often have to be changed.

Figure 2:
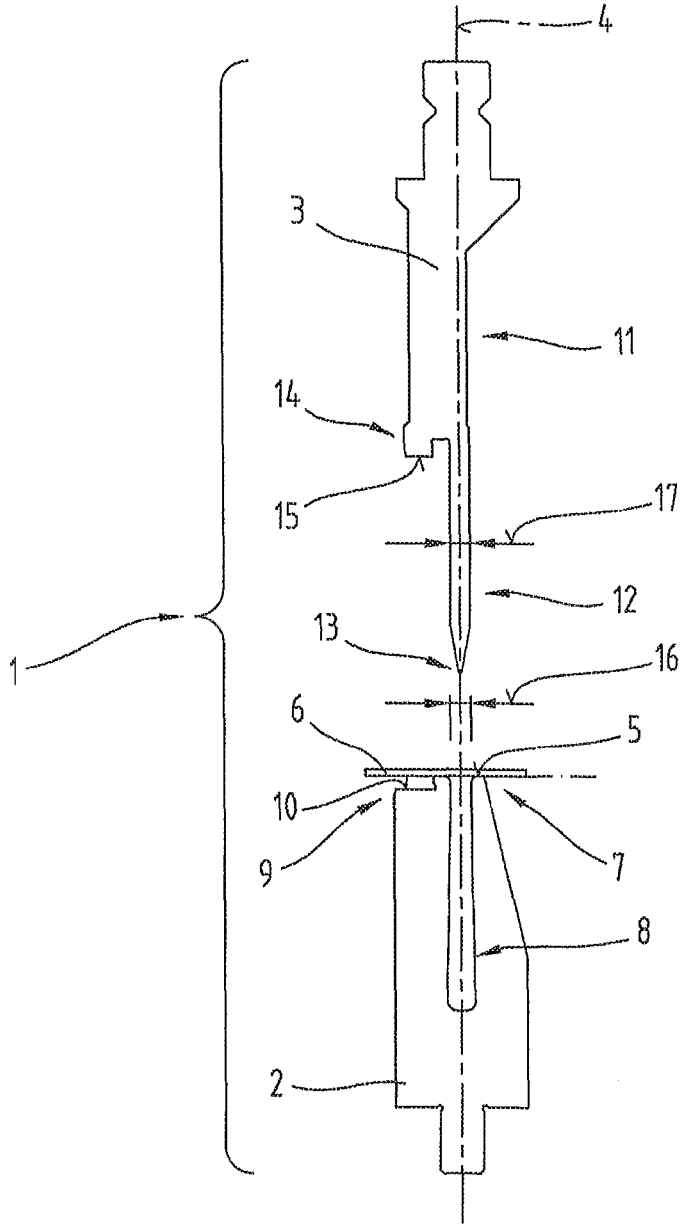
FIG. 2 is a bending tool combination according to the invention, comprising a bending die and bending punch.

FIG. 2 shows a bending tool combination 1, which comprises a bending die 2 according to the invention and a bending punch 3 according to the invention. During use the bending die 2 and bending punch 3 are mounted in a not shown bending press, in particular a folding press, and thus arranged adjustably relative to one another in the direction of a working plane 4. The upper side of the bending die 2 forms a bearing surface 5, on which a flat, planar workpiece section 6 can be placed in order to prebend the latter to form a sharp edge by means of the bending punch 3.

The bending die 2 comprises in the region of the bearing surface 5 a depressed die section 7, into which the workpiece section 6 can be pushed during forming by the bending punch 3. The die section 7 is arranged centrally relative to the working plane 4 and passes into a slot 8 on the inside of the bending die 2, in which the bending punch 3 is received during the hemming of the prebent workpiece section 6.

A hemming section 9 is arranged relative to the working plane 4 to the side of the die section 7 with a hemming surface 10 running perpendicular to the working plane 4, on which hemming surface a prebent workpiece can be positioned for performing the hemming process.

The bending punch 3 according to the invention working with the bending die 2 comprises a punch section 12, which comes from a punch base 11 and is arranged centrally relative to the working plane 4, which in its end section runs wedge-like to a punch tip 13. A hemming section 14 of the bending punch 13 is arranged on the punch base 11 relative to the working plane 4 to the side next to the punch section 12, which hemming section has a hemming surface 15 running perpendicular to the working plane 4. When hemming a prebent workpiece section 6 the hemming surfaces 10 of the bending die 2 and the hemming surface 15 of the bending punch 3 work together, whereby the so-called fold or turnover is formed on the workpiece section 6.

According to the invention, as shown in the further Figures, the hemming surface 10 on the bending die 2 is set back step-like relative to the bearing surface 5 of the die section 7, whereby a stop surface is formed extending from the bearing surface 5 to the hemming surface 10.

Furthermore, on the bending punch 3 according to the invention the hemming section 14 projects relative to the punch base in the direction of the punch tip 13, whereby the hemming surface 15 is raised step-like relative to the punch base and between the punch section 12 and hemming surface 15 a groove-like recess is formed.

The bending die 2 in the die section 7 has a die width 16 which is adapted to the metal sheet thickness to be worked, wherein with increasing metal sheet thicknesses greater die widths 16 are used. The punch section 12 of the bending punch 3 has a punch thickness 17 and the slot 8 in the bending die 2 is configured so that the punch section 12 can be mounted with a small amount of play, for example tenths of millimeters, during the hemming process.

Figure 3:
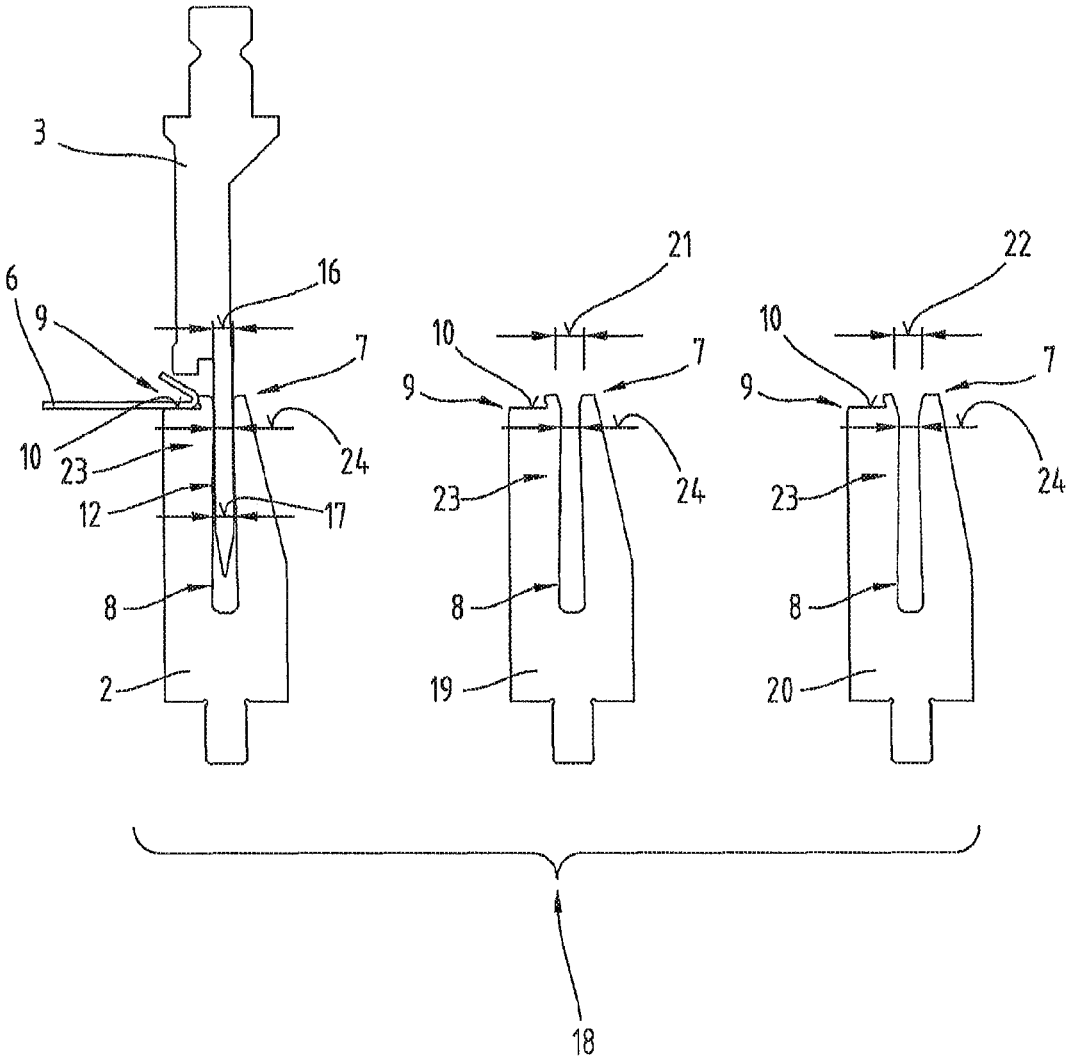
FIG. 3 is a bending tool set according to the invention, comprising a bending punch and a plurality of bending dies with different die widths.

FIG. 3 shows a bending tool set 18 which comprises a bending punch 3 according to the invention as well as three different bending dies 2, 19, 20. The bending tool set 18 can differ from the shown example embodiment and comprises only two bending dies or even more than three bending dies.

The bending dies 2, 19 and 20 have different die widths 16, 21 and 22 and are thereby suitable for bending workpiece sections 6 with different metal sheet thicknesses. Thus for example for workpiece sections 6 with a low metal sheet thickness the bending die 2 with the smallest die width 16 is used, whereas for larger metal sheet thicknesses the bending die 19 with the larger die width 21 or even the bending die 20 with the largest die width 22 is used.

Whereas the bending dies 2, 19 and 20 have different die widths 16, 21 and 22, all three bending dies 2, 19, 20 on the die section 7 have adjoining slots 8, which have a support section 23 adjoining the die section 7, which support section in all of the different bending dies 2, 19 and 20 has an identical internal support width 24. Said internal support width 24 corresponds to the punch thickness 17 in addition to a small amount of play. With a punch thickness of 6 mm the internal support width is for example 6.2 or 6.4 mm. Said support section 23 in the slot 8 means that the punch section 12 is supported perpendicular to the working plane 4 during a hemming process, in which very large deformation forces may be necessary, and thereby a deformation or a break of the punch section 12 is reduced or prevented.

By means of the constant support width 24 in the slot 8 the different bending dies 2, 19, 20 despite the different die widths 16, 21 and 22 can be combined with the same bending punch 3, whereby such a combination would also be possible in a tool combination according to the prior art as in FIG. 1. However, in order to avoid the disadvantages described above during the hemming process when using bending dies with a larger die width, the bending dies 2, 19 and 20 of the die section 7 have separate hemming sections 9 with hemming surfaces 10 set back step-like relative to the bearing surface 5 which cooperate respectively with the hemming surface 15 of the bending punch 3.

Figure 4:
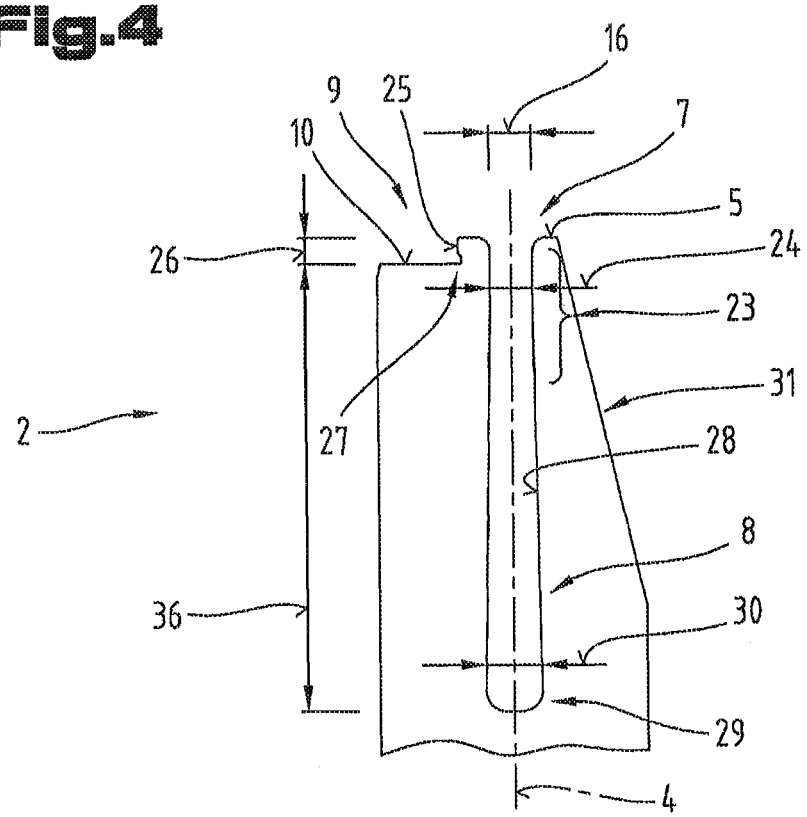

FIG. 4 shows in a detailed view again how according to the invention in the hemming section 9 the hemming surface 10 is set back step-like relative to the bearing surface 5 of the die section 7, whereby a stop surface 25 is formed extending from the bearing surface 5 to the hemming surface 10. A depth offset 26 of the hemming surface 10 relative to the bearing surface 5 is preferably between 30% and 75% of the die width 16 and FIG. 4 shows an example embodiment with a depth offset of about 50% of the die width 16.

The stop surface 25 preferably runs parallel to the working plane 4 and, as indicated in FIG. 4, a groove 27 can be provided between the stop surface 25 and the hemming surface 10, which can take up small amounts of dirt in the hemming section 9 and therefore a workpiece section 6 to be bent is not prevented by dirt from striking the stop surface 25 or lying on the hemming surface 10.

FIG. 4 also shows that the slot 8 leading from the die section 7 into the interior of the bending die 2 adjoining the die section 7 comprises a support section 23, in which the support width 24 is at least approximately constant. A mount contour 28 adjoins the support section 23 which mount contour widens in the direction of the inner end section 29 of the slot 8, whereby on the inside of the slot 8 there is an increased internal width 30 relative to the support width 24. FIG. 4 also shows that the inner contour 28 in the end section 29 of the slot 8 is designed to be rounded and for example has a rounding radius of at least 2 mm. In this way a notching effect reducing the strength can be reduced by the slot 8.

The outer surface on the right in FIG. 4 has a tapering 31, by means of which the material cross-section of the bending die 2 is reduced in the direction of the bearing surface 5 adapted to the load and reducing the weight.

Figure 5:
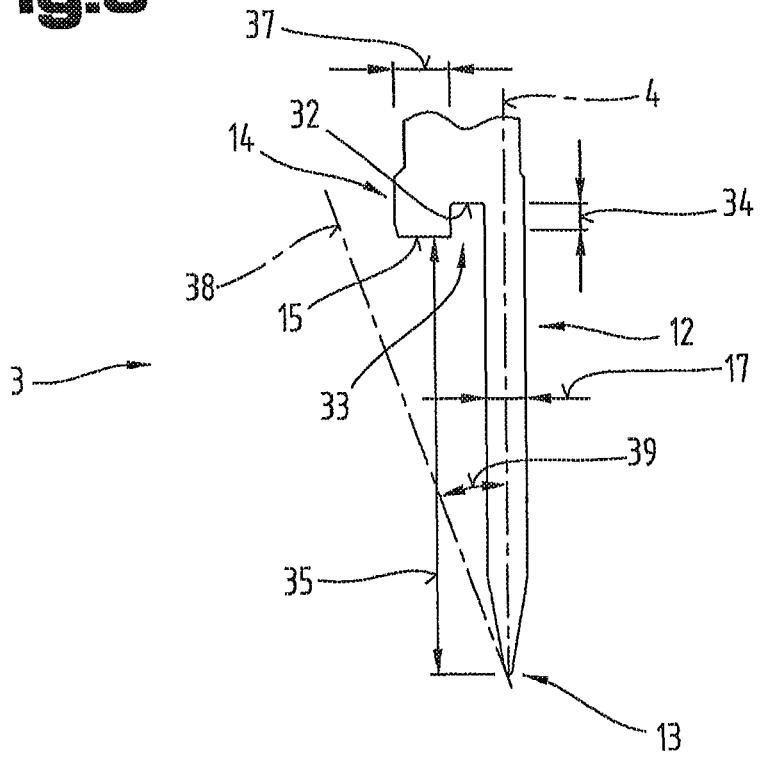
FIG. 4 is a detailed section of a bending die according to the invention with a plurality of alternative or additionally possible embodiment variants and FIG. 5 is a detailed section of a bending punch according to the invention with a plurality of alternative or additionally possible design features.

FIG. 5 shows in a detailed cross section the punch section 12 and the hemming section 14 of a bending punch 3 according to the invention, in which the hemming section 14 projects relative to a punch base surface 32 in the direction of the punch tip 13. Between the punch section 12 and the hemming surface 15 in this way a groove-like recess 33 is formed and the hemming surface 15 projects step-like relative to the punch base surface 32. By means of this design of the hemming section 14 the hemming surface 15 of the bending punch 3 according to the invention can cooperate with the hemming surface 10 of a bending die 2 according to the invention and an optimal hemming process can be ensured, even if bending dies 2 are used with greater die widths 16.

Furthermore, the projection 34 of the hemming section 14 relative to the punch base surface 32 is designed to be greater than the depth offset 26 on the bending die 2, so that the hemming surfaces 10 and 15 can be moved into mutual alignment.

A further requirement to bring the hemming surfaces 10 and 15 into contact is that a punch length 35 measured on the bending punch 3 from the hemming surface 15 to the punch tip 13 is designed to be smaller than a slot depth 36 of the slot 8 formed on the bending die 2 and measured from the hemming surface 10.

As the forming forces required for a hemming process can be very high, in particular can even be greater than the forming forces required for prebending, it is an advantage if the hemming surface 15 on the bending punch 3 perpendicular to the working plane 4 has a greater dimension 37 than the punch thickness 17.

An advantageous embodiment of a bending punch 3 according to the invention can, as shown in FIG. 5, also consist of the fact that the hemming section 14 is arranged completely between the working plane 4 of the punch section 12 and a contour plane 38 coming from the punch tip 13, wherein the contour plane adopts the smallest possible angle 39 relative to the working plane, for example less than 20°, whereby the hemming section 14 is not a disruptive contour for sharp-edged prebendings of a workpiece section 6.

The exemplary embodiments show possible embodiment variants of the bending tools according to the invention, whereby it should be noted at this point that the invention is not restricted to the embodiment variants shown in particular, but rather various different combinations of the individual embodiment variants are also possible and this variability, due to the teaching on technical procedure, lies within the ability of a person skilled in the art in this technical field. Thus all conceivable embodiment variants, which are made possible by combining individual details of the embodiment variants shown and described, are also covered by the scope of protection.

Finally, as a point of formality, it should be noted that for a better understanding of the structure of the bending tools, the latter and its components have not been represented true to scale in part and/or have been enlarged and/or reduced in size.

The underlying objective of the independent solutions according to the invention can be taken from the description.

Mainly the individual embodiments shown in FIGS. 2; 3; 4 and 5 can form the subject matter of independent solutions according to the invention. The objectives and solutions according to the invention relating thereto can be taken from the detailed descriptions of these figures.

Lastly, it should be noted that in the variously described exemplary embodiments the same parts have been given the same reference numerals and the same component names, whereby the disclosures contained throughout the entire description can be applied to the same parts with the same reference numerals and same component names. Also details, relating to position used in the description, such as e.g. top, bottom, side etc. relate to the currently described and represented figure and in case of a change in position should be adjusted to the new position. Furthermore, also individual features or combinations of features from the various exemplary embodiments shown and described can represent in themselves independent or inventive solutions.

All of the details relating to value ranges in the present description are defined such that the latter include any and all part ranges, e.g. a range of 1 to 10 means that all part ranges, starting from the lower limit of 1 to the upper limit 10 are included, i.e. the whole part range beginning with a lower limit of 1 or above and ending at an upper limit of 10 or less, e.g. 1 to 1.7, or 3.2 to 8.1 or 5.5 to 10.

| List of reference numerals | |
|---|---|
| 1 | bending tool combination |
| 2 | bending die |
| 3 | bending punch |
| 4 | working plane |
| 5 | support area |
| 6 | workpiece section |
| 7 | die section |
| 8 | slot |
| 9 | hemming section |
| 10 | hemming surface |
| 11 | punch base |
| 12 | punch section |
| 13 | punch tip |
| 14 | hemming section |
| 15 | hemming surface |
| 16 | die width |
| 17 | punch thickness |
| 18 | bending tool set |
| 19 | bending die |
| 20 | bending die |
| 21 | die width |
| 22 | die width |
| 23 | support section |
| 24 | support width |
| 25 | stop surface |
| 26 | depth offset |
| 27 | groove |
| 28 | mount contour |
| 29 | end section |
| 30 | internal width |
| 31 | tapering |
| 32 | punch base surface |
| 33 | recess |
| 34 | projection |
| 35 | punch length |
| 36 | slot depth |
| 37 | dimension |
| 38 | contour plane |
| 39 | angle |

The invention claimed is:

1. A bending tool combination for v-shaped prebending and subsequent hemming of a flat workpiece section, the bending tool combination comprising:

(a) a working plane;

(b) a bending punch comprising a punch tip, a punch base surface, a punch section arranged centrally relative to the working plane and extending from the punch base surface, and a bending punch hemming section comprising a bending punch hemming surface arranged laterally to the punch base surface and projecting relative to the punch base surface toward the punch tip, wherein the bending punch hemming surface projects in a stepped manner relative to the punch base surface;

(c) a bending die adjustably arranged relative to the bending punch in a direction of the working plane, the bending die comprising an interior, a die section arranged centrally relative to the working plane and having a bearing surface, a slot having a slot depth and leading from the bearing surface into the interior for partly receiving the bending punch during a hemming operation, a bending die hemming section comprising a bending die hemming surface arranged laterally relative to the working plane and set back in a stepped manner relative to the bearing surface, and a stop surface extending from the bearing surface to the bending die hemming surface; and (d) a groove-shaped recess formed between the punch section and the bending punch hemming surface;

wherein as measured in an operating direction, the slot depth measured from the bending die hemming surface is greater than a punch length measured from the bending punch hemming surface up to the punch tip.

2. The bending tool combination as claimed in claim 1, wherein the slot following the die section of the bending die has a support section with a constant internal support width.

3. The bending tool combination as claimed in claim 2, wherein a mount contour adjoining the support section of the bending die widens towards an inner end section of the slot.

4. The bending tool combination as claimed in claim 2, wherein a mount contour adjoining the support section is rounded at an inner end section of the slot of the bending die with a radius of curvature of at least 2 mm.

5. The bending tool combination as claimed in claim 1, wherein a depth offset of the bending die hemming surface relative to the bearing surface of the bending die is between 30% and 75% of the die width.

6. The bending tool combination as claimed in claim 1, wherein the bending die is tapered on an outer side opposite the bending die hemming section relative to the working plane so that a material cross section of the bending die decreases in a wedge-shaped manner towards the bearing surface.

7. The bending tool combination as claimed in claim 1, wherein the die section and the bending die hemming surface of the bending die have hardened surfaces.

8. The bending tool combination as claimed in claim 1, wherein the bending punch hemming surface of the bending punch measured perpendicular to the working plane has a greater dimension than a punch thickness of the bending punch.

9. The bending tool combination as claimed in claim 1, wherein the bending punch hemming section of the bending punch is arranged entirely between the working plane and a contour plane extending from the punch tip and inclined about an angle of less than 20° to the working plane.

10. The bending tool combination as claimed in claim 1, wherein the punch tip and the bending punch hemming surface of the bending punch have hardened surfaces.

11. A bending tool set for v-shaped prebending and subsequent hemming of a flat workpiece section, the bending tool set comprising:

(a) a working plane;

(b) at least one bending punch with a constant punch thickness perpendicular to the working plane, wherein the at least one bending punch comprises a punch tip, a punch base surface, a punch section arranged centrally relative to the working plane and extending from the punch base surface, and a bending punch hemming section comprising a bending punch hemming surface arranged laterally to the punch base surface and projecting relative to the punch base surface toward the punch tip, wherein the bending punch hemming surface projects in a stepped manner relative to the punch base surface;

(c) at least first and second bending dies; and (d) a groove-shaped recess formed between the punch section and the bending punch hemming surface;

wherein the first and second bending dies comprise, respectively, first and second interiors, first and second die sections arranged centrally relative to the working plane and having, respectively, first and second bearing surfaces, first and second slots leading into the first and second interiors of the first and second bending dies, respectively, for partly receiving the at least one bending punch during a hemming operation, first and second bending die hemming sections comprising, respectively, first and second bending die hemming surfaces arranged laterally with respect to the working plane and set back in a stepped manner relative to the first and second bearing surfaces, respectively, and first and second stop surfaces extending from the first and second bearing surfaces to the first and second bending die hemming surfaces, respectively; and wherein each of the first and second bending dies on a respective inside of the first and second slots, respectively, has an identical internal support width corresponding to the punch thickness in addition to play and the first die section in a region of the first bearing surface has a first die width different from a second die width of the second die section in a region of the second bearing surface.

* * * * *